United States Patent [19]

Gartzke

[11] 4,265,148

[45] May 5, 1981

[54] RATCHET TOOL

[76] Inventor: Rudolf E. Gartzke, 2326 Superior St., Madison, Wis. 53704

[21] Appl. No.: 966,110

[22] Filed: Dec. 4, 1978

[51] Int. Cl.[3] ..... B25B 17/00

[52] U.S. Cl. ..... 81/57.29; 192/21; 81/59.1

[58] Field of Search ..... 81/57.13, 57.29, 58.1, 81/59.1; 192/21, 48.92, 47

[56] References Cited

U.S. PATENT DOCUMENTS

| | | | |
|---|---|---|---|
| 499,226 | 6/1893 | Heineke | 192/21 |
| 1,384,811 | 7/1921 | Strand | 81/57.13 |
| 3,329,185 | 7/1967 | Hettich et al. | 81/59.1 |
| 3,398,612 | 8/1968 | Batten | 81/59.1 |
| 3,952,617 | 4/1976 | Gegg | 81/62 |

FOREIGN PATENT DOCUMENTS

| | | | |
|---|---|---|---|
| 40-1035569 | 6/1965 | Japan | 81/57.29 |

*Primary Examiner*—James L. Jones, Jr.
*Attorney, Agent, or Firm*—Keith Schoff

[57] ABSTRACT

A ratchet tool is designed for one-handed manipulation by embodying push-pull biasing of the handle for selecting the direction of rotational drive and twisting or arcuate swinging actuation of the handle for rotationally driving the tool head.

5 Claims, 2 Drawing Figures

RATCHET TOOL

FIELD OF APPLICATION

Ratchet tools enable continuous application of a rotatable tool engaging a work piece or threaded part to be maintained under conditions which would otherwise require repeated removal and reapplication of the tool on the workpiece for operable use, such as when there is limited clearance for rotating a tool handle.

BACKGROUND OF THE INVENTION

A ratchet tool is described in U.S. Pat. No. 3,952,617 which embodies dual operating modes of swinging and of twisting the tool handle to drive a tool head, but the tool like other prior art tools requires the use of two hands to change the direction of rotational drive if the tool is not removed from the workpiece. In some situations it may be necessary for the user of a ratchet tool to maintain a grasp on the tool with one hand and on a workpiece with the other hand, making it awkward or impossible for him to conveniently reverse the direction of tool drive rotation.

SUMMARY OF THE INVENTION

A ratchet tool is provided with a rotatable drive head cut with ring gear teeth disposed to be engaged with a drive pinion, and the drive pinion to be engaged alternately by one of a pair of overrunning clutches arranged to transmit torque in opposite rotational directions when the shaft upon which the clutches are mounted is rotated by the handle of the tool being twisted. Selection of the overrunning clutch to be engaged with the pinion to impart right-hand or left-hand rotation to the pinion as desired is made by push-pull biasing of the handle in its axial direction. Arcuate swinging of the handle also imparts driving motion to the tool head either simultaneously or independently of handle twisting motion when one or the other of the clutches is engaged.

DESCRIPTION OF THE INVENTION

Figure 1:
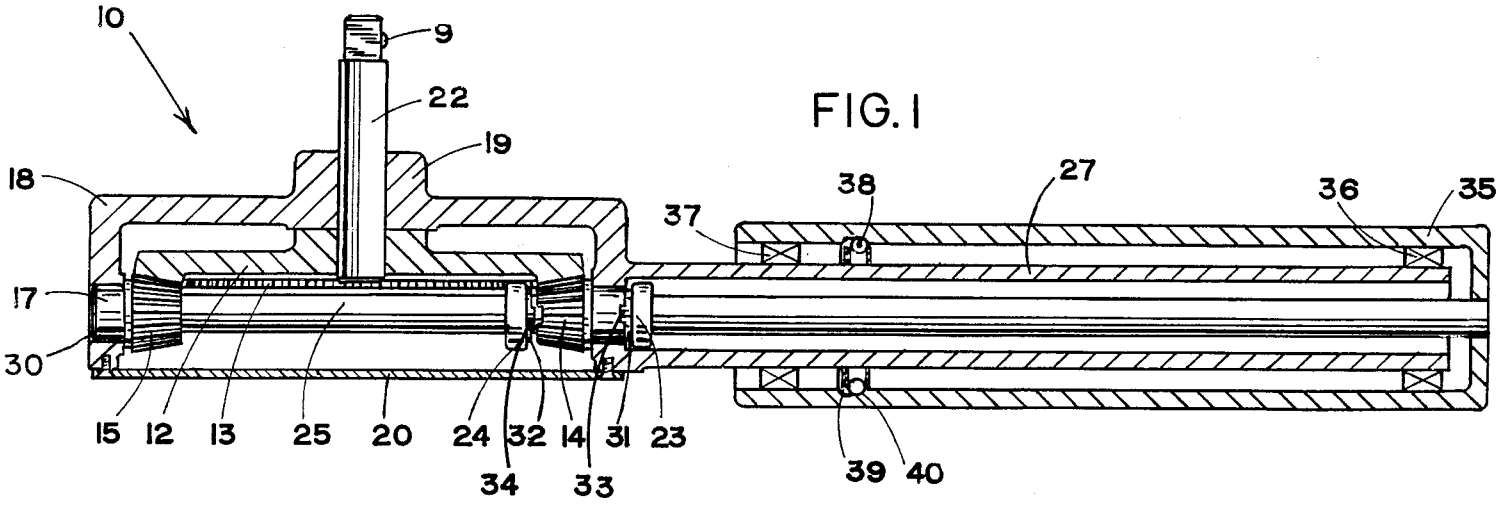
FIG. 1 is a cross-sectional elevation of one embodyment of the invention.
Figure 2:
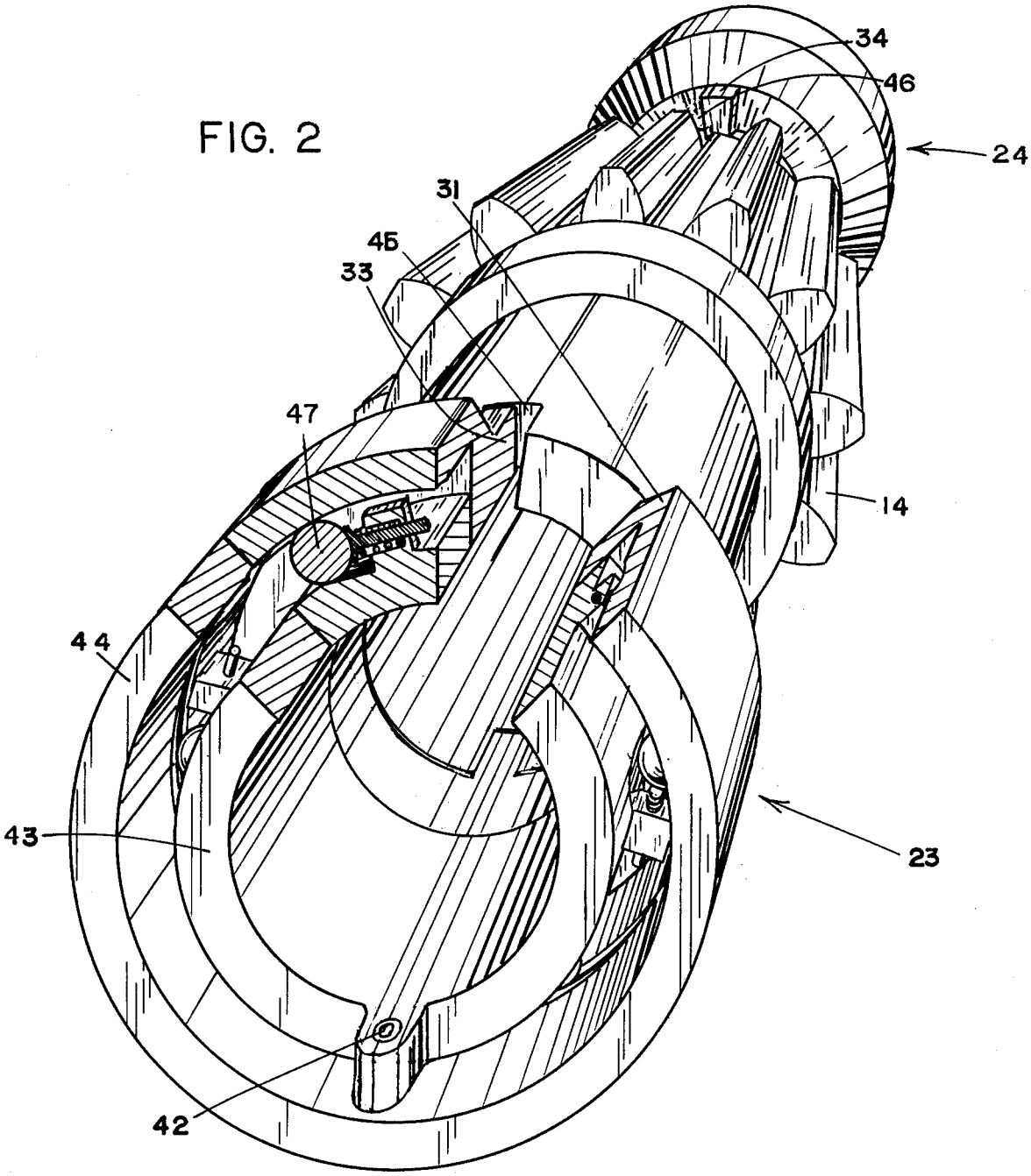
FIG. 2 is a perspective view in partial section of the detail assembly of overrunning clutches and pinion of FIG. 1.

Referring to FIGS. 1 and 2, tool 10 comprises rotatable head member 12 fitted with output shaft 22 secured in the opening through hub 19. The lower portion of shaft 22 is circular in cross-sectional configuration and machined to provide a bearing surface, and the upper portion is preferably square in cross-sectional configuration and provided with spring biased sphere 9 for receiving and securing a socket or other tool head attachment in a manner conventional for bayonet fittings. Case 18 is of circular configuration with inner handle 27 projecting radially, the inboard end face of the handle as well as the diametrically opposite inner peripheral face of case 18 and the inboard face of hub 19 all being shown of thickened section and machine finished to provide bearing surfaces to operably withstand thrust loading. Cover plate 20 is disposed on the bottom of case 18 providing a closure for the case. Bevel gear teeth 13 are cut in the lower peripheral extremity of head member 12, meshing with teeth on pinions 14 and 15. Pinion 15 is an idler which is mounted by stem 17 set in recess 30 of case 18 for operable rotation. Pinion 14 is mounted by being journaled both into case 18 and on shaft 25 for rotation free of the shaft, and shaft 25 is freely moveable axially within pinion 14, the outboard face of pinion 14 being machined to bear with thrust loading against the machined surface of case 18. Shaft 25 is press-fitted as shown or otherwise operably fixed at its outboard end to handle sleeve 35 and extends to a terminus within the axial bore of pinion 15, the shaft being freely biasable both axially and rotationally within the bore. Handle sleeve is carried on bearings 36 and 37 which are mounted on inner handle 27 thus enabling handle sleeve 35 to undergo both push-pull axially translational biasing and rotational biasing about the handle axis. Biasing of handle sleeve 35 is transmited directly to shaft 25. A pair of closely adjacent annular grooves 39 and 40 are provided on the inner peripheral face of handle sleeve 35 disposed to register alternately with spring biased spherical detents 38 which retain handle sleeve 35 and shaft 25 in proper position to operably engage one or the other of overrunning clutches 23 and 24 with pinion 14.

Fixed fastening of shaft 25 to the inner races of clutches 23 and 24 is accomplished by use of means such as set screw 42 shown disposed in inner race 43 of clutch 23, comparable means being provided in clutch 24.

Overrunning clutches 23 and 24 are identical in construction and are set to be oppositely facing on shaft 25, one for engaging one face of pinion 14 and the other for engaging the opposite face. The overrunning clutches are of conventional design and other conventional means may be used such as ratchet and pawl assemblies to perform the function of providing engagement with shaft 25 in one direction of rotation and disengagement in the other direction. In clutch 23 balls 47 are cause to wedge between inner race 43 and outer race 44 when shaft 25 is rotated in right hand direction as viewed in FIG. 2. Left hand rotation of shaft 25 causes inner race 43 to free wheel without engaging by wedging action outer race 44, however, such rotation causes the inner and outer races of clutch 24 to lock and drive pinion 14 if engaged therewith, clutch 24 being set oppositely from clutch 23 on shaft 25.

Hubs 31 and 32 are fixed to outer races of clutches 23 and 24, respectively, such as outer race 44 of clutch 23. The circumference of each hub 31 and 32 is cut with teeth-like keys 33 and 34, respectively, which can engage in keyways 45 and 46, respectively, in pinion 14. Engagement of one or the other of hubs 31 and 32 with pinion 14 by meshing of keys 33 or 34 with keyways 45 or 46 results when handle sleeve 35 is biased translationally in the axial direction of the handle to move detents 38 into registry with one of grooves 39 and 40.

Figure 3:
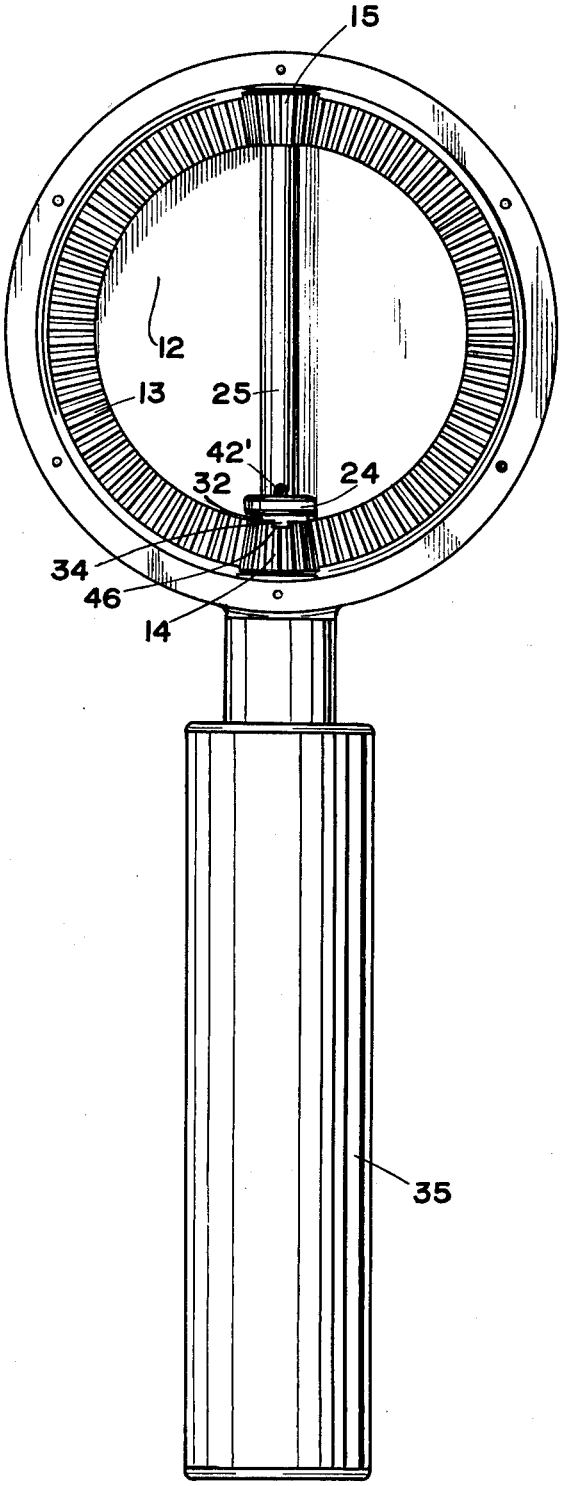
FIG. 3 is a bottom view of the embodiment of FIG. 1 with the cover plate removed.
Figure 4:
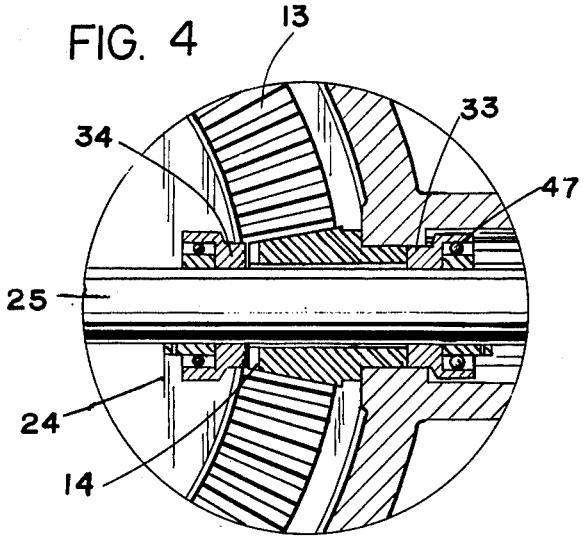

In FIG. 3, ratchet tool 10 is shown with bottom cover plate 20 removed, exposing to view shaft 25 with pinions 14 and 15 journaled thereon and in fixed engagement with gear teeth 13 of head member 12, and with overrunning clutch 24 together with attached hub 32 operably disposed on shaft 25 shown with key 34 engaged in keyway 46 of pinion 14 in position rotated 90 degrees from that shown in FIG. 1, and in complementary alternate position to that shown in FIG. 1 where key 34 is shown disengaged from keyway 46 and with key 33 engaged in keyway 45. To shift between one engaged position and the other, i.e. to alternate between key 33 being engaged in keyway 45 providing right hand tool drive as shown in FIG. 2, and key 34 being engaged in keyway 46 providing left hand tool drive as shown in FIG. 3, handle sleeve 35 with fixed attachment to shaft 25 and overrunning clutches 23 and 24 is manually biased by pushing the handle sleeve toward the tool head to provide right hand drive and pulling it away to provide left hand drive, proper engagement being both felt and by registry of detents 38 being heard. Set screw 42' is provided to fix the inner race of clutch 24 to shaft 25.

In use, ratchet tool 10 is provided with an attachment such as a socket or other fitting on shaft 22 for enabling the tool to be used as, for example, a wrench. The socket or other attachment is operably engaged with a part, such as the head of a bolt, which it may be desired to remove from a workpiece. Assuming the part is threaded with right hand threads, handle sleeve 35 is biased translationally by being drawn away from case 18 until detents 38 are heard to click into registry with groove 39, and then the tool, being disposed with clutch 24 operably engaged and clutch 23 disengaged and the handle of radially extending from the axis of shaft 22 may either by swung about the axis of shaft 22 in left hand rotation to remove the part from the work piece, with the handle being arcuately worked, if clearance is obstructed, without causing right hand rotation of head member 12 to occur, or handle sleeve 35 may be twisted with left hand rotation to rotatably drive shaft 22 in left hand rotation to remove the part from the workpiece, with reverse or right hand twisting of the handle imparting no motion to head member 12. Both the swinging and twisting modes of operation may be used simultaneously, the rotational effect being additive. To reverse the direction of rotation for driving the treaded part into the workpiece with right hand rotation, handle sleeve 35 is biased by being manually pushed in axial direction toward case 18 without the use of the tool being required to release his grip on the tool handle; when detents 38 are heard to register in groove 40, clutch 23 is engaged and clutch 24 is disengaged and the manipulative operations above described are repeated with right hand direction of rotation or twisting, however. The capability provided in tool 10 is that of driving a part in either direction of rotation and for reversing direction of rotation with single handed manipulation and without requiring the user to release his grip on the tool. The capacity for using the tool with single hand manipulation is especially useful when clearance in a conjested space allows only for arcuate swinging of the tool through a few degrees of traverse or requires the twist mode of operation to be employed and the operator is unable to free either hand for separately operating a direction reversing selector on the tool, as heretofore has been necessary on ratchet tools.

In a non-preferred embodiment clutches 23 and 24 may be set to engage pinions 15 and 14, respectively, with both clutches being engaged by the same direction of handle twisting motion, or if the clutches are designed to engage in opposite rotational directions, then in the manner hereabove described, push-pull handle biasing being necessary in either case to effect directional reversal of the tool head. Other embodiments utilizing push-pull handle biasing for selecting direction of tool head rotation will be apparent, but all such embodiments of this invention utilize translational manipulation of the handle to select the direction of tool head rotation. Any operable overrunning coupler may be used in place of the overrunning clutch shown in the drawings, there being numerous variations of such couplers, which are also known as one-way or freewheeling couplers and clutches.

I claim:

1. A ratchet tool comprising, (a) a frame configured with a casing head portion and an elongated annular handle portion, (b) a sleeve disposed substantially concentrically about said annular handle portion and mounted for rotational and axial biasing relative thereto, (c) a shaft coaxial with said sleeve and affixed thereto extending axially through said handle portion, (d) a tool head rotatably mounted within said casing head portion and provided with a gear portion having peripherally cut gear teeth, (e) at least one pinion disposed about said shaft for engaging said gear teeth, (f) a pair of overrunning couplers disposed with inner races thereof fixedly secured to said shaft and with outer races thereof fitted with means engaged alternately by axial biasing of said shaft and affixed sleeve, with at least said one pinion, thereby to enable said tool head to be operably driven in either rotational direction selectively by said couplers being set to operably be engaged by rotation of said shaft, one in one position of axial biasing of said shaft and the other in the other position of axial biasing of said shaft, to drive at least one pinion and said tool head.

2. The tool of claim 1 wherein said couplers comprise overrunning clutches.

3. The ratchet tool of claim 1 wherein said shaft is fixed to said sleeve and to said overrunning couplers and is slidably traversable within said pinion, said couplers being coupled to said at least one pinion by axial biasing of said shaft.

4. The ratchet tool of claim 1 wherein said means engaged alternately by axial biasing of said shaft comprises axial extending keys engaging said pinion.

5. The ratchet tool of claim 1 wherein said peripherally cut gear teeth and said pinion comprise a bevel gear set.

* * * * *